United States Patent [19]

Rasmussen

[11] Patent Number: 5,009,627

[45] Date of Patent: Apr. 23, 1991

[54] COIN SORTING MECHANISM

[75] Inventor: James M. Rasmussen, Chicago, Ill.

[73] Assignee: Cummins-Allison Corp., Mt. Prospect, Ill.

[21] Appl. No.: 323,271

[22] Filed: Mar. 14, 1989

[51] Int. Cl.[5] ..... G07D 3/06

[52] U.S. Cl. ..... 453/10; 453/12

[58] Field of Search ..... 453/3, 6, 9, 10, 12, 453/13, 58; 221/167, 168, 169

[56] References Cited

U.S. PATENT DOCUMENTS

| | | | |
|---|---|---|---|
| 2,906,276 | 9/1955 | Blanchette et al. . | |
| 3,939,954 | 2/1976 | Collins . | |
| 4,086,928 | 5/1978 | Ristvedt . | |
| 4,098,280 | 6/1978 | Ristvedt . | |
| 4,234,003 | 11/1980 | Ristvedt . | |
| 4,444,212 | 4/1984 | Ristvedt . | |
| 4,474,197 | 10/1984 | Kinoshita et al. . | |
| 4,506,685 | 3/1985 | Childers et al. . | |
| 4,531,531 | 6/1985 | Johnson et al. . | |
| 4,543,969 | 10/1985 | Rasmussen . | |
| 4,549,561 | 10/1985 | Johnson et al. . | |
| 4,564,036 | 1/1986 | Ristvedt . | |
| 4,564,037 | 1/1986 | Childers et al. . | |
| 4,570,655 | 2/1986 | Raterman . | |
| 4,586,522 | 5/1986 | Taipale et al. . | |
| 4,607,649 | 8/1986 | Taipale et al. . | |
| 4,731,043 | 3/1988 | Ristvedt | 453/6 |
| 4,775,354 | 10/1988 | Rasmussen et al. | 453/10 |

FOREIGN PATENT DOCUMENTS

| | | | |
|---|---|---|---|
| 0285240 | 10/1988 | European Pat. Off. | 453/10 |

*Primary Examiner*—H. Grant Skaggs

*Attorney, Agent, or Firm*—Arnold, White & Durkee

[57] ABSTRACT

In a coin sorter of the kind in which coins of mixed denomination are sorted between a rotating resilient disc and a sorting head, stacked coins are broken up and the excess coins recirculated prior to referencing a single-file stream of coins to a fixed radial position and recirculating excess coins that are not properly referenced. By recirculating the coins in these two different circumstances, the breaking up of the stacked coins does not hinder the referencing of the coins, and consequently the possibility of miss-sorting due to stacked coins is reduced and the sorting speed is increased, especially when sorting predominately small thin coins such as dimes. To increase the sorting speed when small thin coins are mixed with large thick coins, the large thick coins are preselected before being referenced together with the coins of other denominations. Preferably, thick coins which are not initially referenced to an extreme outward radial position are recirculated prior to reaching the deflecting wall which breaks up double coins, since such thick coins would otherwise hinder the flow of thin coins.

14 Claims, 5 Drawing Sheets

COIN SORTING MECHANISM

BACKGROUND OF THE INVENTION

1. Field of the Invention

The present invention relates generally to coin sorting devices and, more particularly, to coin sorters of the type which use a resilient rotating disc and a stationary sorting head for sorting coins of mixed denominations.

2. Description of the Related Art

In coin sorters of the foregoing type, coins are pressed into a resilient disc for positive control throughout referencing, sorting and ejection movements. Such positive control permits the coin sorter to be quickly stopped by braking of the rotation of the resilient disc when a preselected number of coins of a selected denomination have been ejected from the sorter. Positive control also permits the sorter to be relatively compact yet operate at high speed.

A disadvantage of obtaining positive control of coins by pressing the coins into engagement with a sorting head is the possibility of stacked or "double coins" impeding the flow of unstacked or "single coins" through the sorter. A "double coin" condition occurs when two thin coins are engaged one on top of the other between the resilient disc and the sorting head. Although means have been provided for breaking up the "double coins" before the coins are referenced, such means have been unreliable for cases when the "double coin" has the same thickness as a "single coin" of another denomination, and a failure to break a "double coin" before referencing causes the chance of miss-sorting to become significant. The means for breaking up the stacked or double coins has also unduly limited the speed of the sorter by causing, in many instances, more than just one of the two coins in each "double coin" to be recirculated, and these recirculated coins have interfered with the feeding of single coins to the referencing means.

SUMMARY OF THE INVENTION

The present invention avoids miss-sorting and loss of sorting speed by breaking up stacked or "double coins" in such a way that one coin in each double coin is recirculated and the other is directed to a referencing means. The referencing means, for example, recirculates coins that fail to become referenced due to a high density of coins reaching the referencing means Since "double coins" are broken up before they reach the referencing means, the possibility of miss-sorting is greatly reduced. Moreover, the means for breaking up the double coins also includes a recirculating means separate from the recirculating means of the referencing means, and therefore the presence of double coins does not reduce the sorting speed.

To increase the sorting speed when small thin coins are mixed with large thick coins, the large thick coins are preselected before being referenced together with the coins of other denominations. Preferably, thick coins which are not initially referenced to an extreme outward radial position are recirculated prior to reaching the means for breaking up double coins, since such thick coins would otherwise hinder the flow of thin coins to the referencing means.

Figure 1:
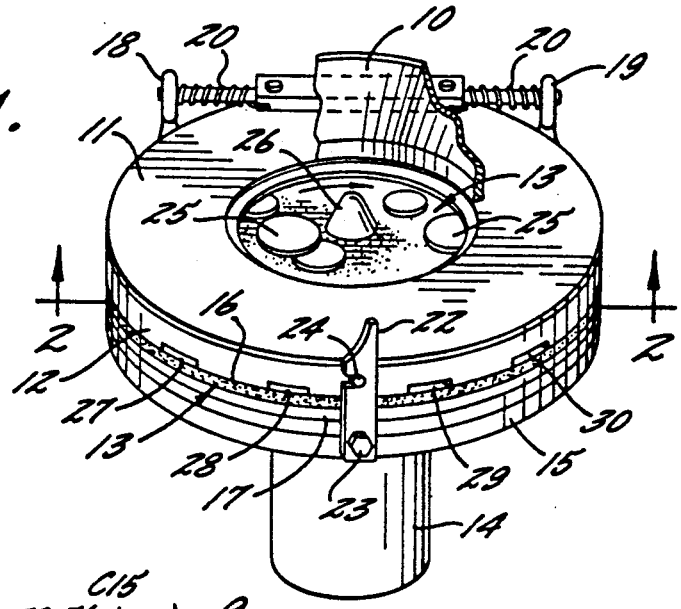
FIG. 1 is perspective view of a coin sorter embodying the present invention, with a top portion thereof broken away to show internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

DESCRIPTION OF THE PREFERRED EMBODIMENT

Turning now to the drawings and referring first to FIG. 1, a hopper 10 receives coins of mixed denominations and feeds them through central openings in a housing 11 and an annular sorting head or guide plate 12 inside or underneath the housing. As the coins pass through these openings, they are deposited on the top surface of a rotatable disc 13. This disc 13 is mounted for rotation on a stub shaft (not shown) and driven by an electric motor 14 mounted to a base plate 15. The disc 13 comprises a resilient pad 16 bonded to the top surface of a solid metal disc 17. The top surface of the resilient pad 16 is preferably covered with a durable fabric bonded to the pad itself, which is preferably made of a resilient rubber or polymeric material.

The top surface of the resilient pad 16 is preferably spaced from the lower surface of the sorting head 12 by a gap of about 0.005 inches (0.13 mm). The gap is set around the circumference of the sorting head 12 by a three point mounting arrangement including a pair of rear pivots 18, 19 loaded by respective torsion springs 20, 21 which tend to elevate the forward portion of the sorting head. During normal operation, however, the forward portion of the sorting head 12 is held in position by a latch 22 which is pivotally mounted to the frame 15 by a bolt 23. The latch 22 engages a pin 24 secured to the sorting head. For gaining access to the opposing surfaces of the resilient pad 16 and the sorting head, the latch is pivoted to disengage the pin 24, and the forward portion of the sorting head is raised to an upward position (not shown) by the torsion springs 20, 21. This is occasionally done, for example, to inspect the sorting head 12 or disc 13 for unusual wear or to remove foreign objects.

As the disc 13 is rotated, the coins 25 deposited on the top surface thereof tend to slide outwardly over the surface of the pad due to centrifugal force. The coins 25, for example, are initially displaced from the center of the disc 13 by a cone 26, and therefore are subjected to sufficient centrifugal force to overcome their static friction with the upper surface of the disc. As the coins move outwardly, those coins which are lying flat on the pad enter the gap between the pad surface and the guide plate 12 because the underside of the inner periphery of this plate is spaced above the pad 16 by a distance which is slightly greater than the thickness of the thickest coin. As further described below, the coins are sorted into their respective denominations, and the coins for each denomination issue from a respective exit slot, such as the slots 27, 28, 29 and 30, for nickels, quarters, dollars, and half-dollars, respectively.

In general, the coins for any given currency are sorted by the variation in diameter for the various denominations, although in many cases it is desirable or necessary to also sort by variation in thickness. The coins circulate between the sorting head and the rotating disc until a single-file stream of coins is obtained One edge of the coins in this stream of coins is aligned, and possibly adjusted somewhat based on coin thickness, so that the other edge of the coins is subsequently gaged against gaging surfaces for directing the coins to the exit slots for the respective denominations.

Preferably most of the aligning, referencing, sorting, and ejecting operations are performed when the coins are pressed into engagement with the lower surface of the sorting head 12. In other words, the distance between the lower surfaces of the sorting head 12 of the passages conveying the coins and the upper surface of the rotating disc 13 will be less than the thickness of the coins being conveyed. As introduced above, such positive control permits the coin sorter to be quickly stopped by braking of the rotation of the disc 13 when a preselected number of coins of a selected denomination have been ejected from the sorter. Positive control also permits the sorter to be relatively compact yet operate at high speed. The positive control, for example, permits the single file stream of coins to be relatively dense, and ensures that each coin in this stream can be directed to a respective exit slot instead, for example, of being recirculated.

As introduced above, a disadvantage of obtaining positive control of coins by pressing the coins into engagement with a sorting head is the possibility of stacked or "double coins" impeding the flow of unstacked or "single coins" through the sorter. This problem is especially severe for sorting foreign coin in which the "double coin" has the same thickness as a "single coin" of another denomination. A worst case, for example, occurs for Dutch currency in which the Dutch "dime" has a thickness of 0.053 inches (1.35 mm) and a diameter of 0.591 inches (15.0 mm), and the Dutch "5 gilder" coin has a thickness of 0.105 inches (2.67 mm) and a diameter of 0.925 inches (23.5 mm). When sorting U.S. coin, the "double coin" problem can cause a noticeable loss of sorting speed and relatively high possibility of miss-sort when sorting coinage consisting essentially of dimes.

Figure 2:
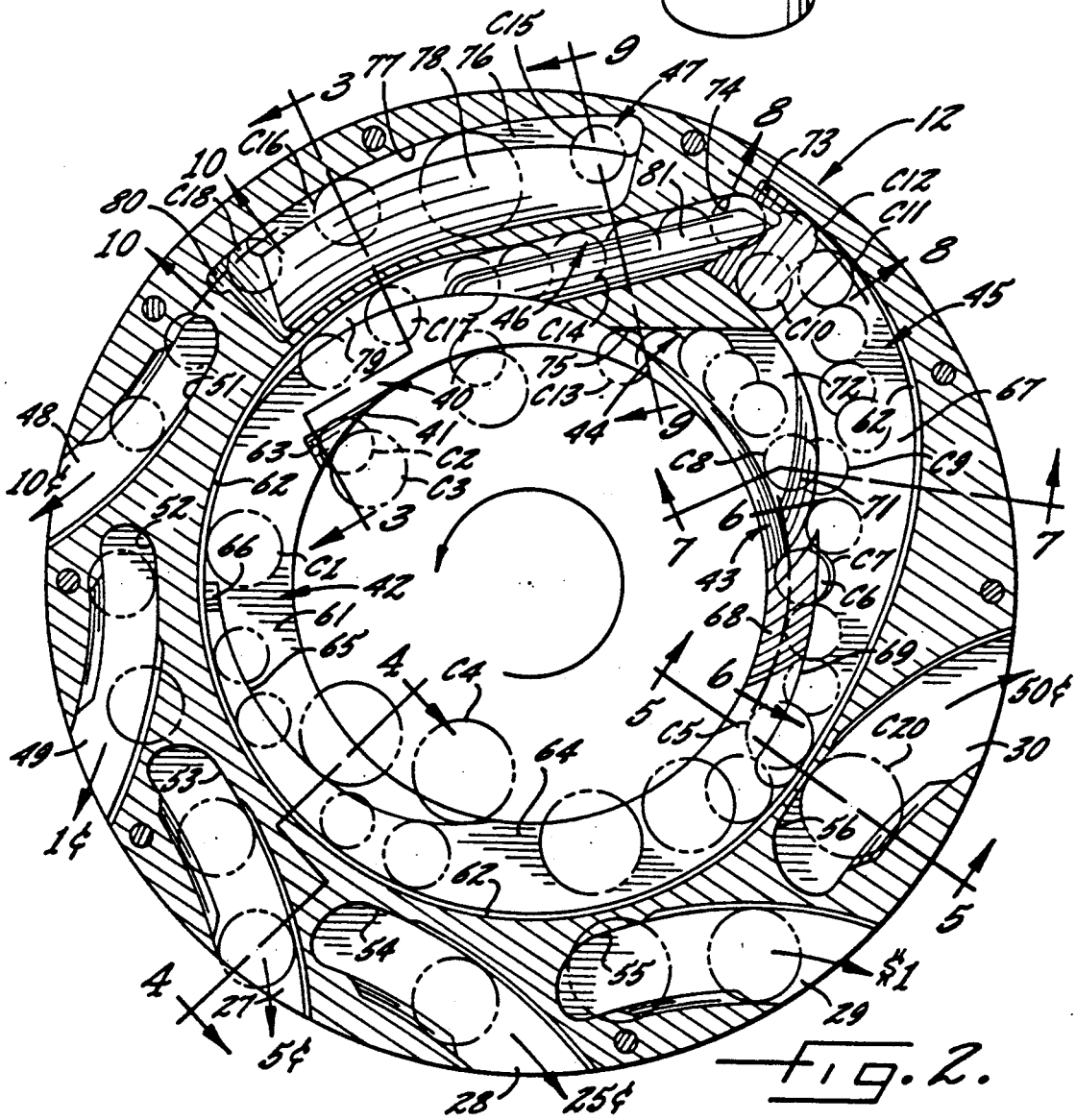
FIG. 2 is an enlarged horizontal section taken generally along the line 2—2 in FIG. 1 to show the configuration of the underside of the sorting head or guide plate, with hatching added to the lowermost surface of the guide plate to more clearly identify the recessed areas, and with various coins superimposed thereon to illustrate the functions of the guide plate.

Turning now to FIG. 2, there is shown a bottom view of the preferred sorting head 12 including various channels and other means especially designed for high-speed sorting with positive control of the coins, yet avoiding the "double coin" problem. With an eleven-inch sorting head 12, it is possible to rotate the disc 13 at about 200 RPM, stop the rotation in about 20 msec using an electromagnetic friction brake (not shown), and sort thousands of coins per minute, depending upon the diameter of the coins being sorted.

It should be kept in mind that the circulation of the coins, which is clockwise in FIG. 1, appears counterclockwise in FIG. 2 because FIG. 2 is a bottom view. The various means operating upon the circulating coins include an entrance region 40, means 41 for stripping "shingled" coins, means 42 for selecting thick coins, means 43 for breaking up stacked coins including first means 44 for recirculating coins, first referencing means 45 including means 46 for recirculating coins, second referencing means 47, and the exit means 48, 49, 27, 28, 29, 30 including respective gaging means 51, 52, 53, 54, 55, and 56 for six different coin denominations, such as dimes, pennies, nickels, quarters, dollars and half-dollars.

Considering first the entrance region 40, the outwardly moving coins initially enter under a semi-annular region underneath a planar surface 61 formed in the underside of the guide plate or sorting head 12. Coin C2, superimposed on the bottom plan view of the guide plate in FIG. 2 is an example of a coin which has entered the entrance region 40. The planar surface 61 is spaced above the lowermost (cross-hatched) surface of the sorting head 12 by about 0.110 inches (2.79 mm) and therefore is spaced above the top surface of the pad 16 by a distance of about 0.115 inches (2.92 mm) which is greater than the thickness of the thickest denomination of coin.

Free radial movement of the coins within the entrance region 40 is terminated when they engage a wall 62, though the coins continue to move circumferentially along the wall 62 by the rotational movement of the pad 16, as indicated by the central arrow in the counterclockwise direction in FIG. 2. The wall 62 is preferably tapered to minimize abrasion by minimizing the area of contact between the coins and the recess wall.

To prevent the entrance region 40 from becoming blocked by shingled coins, the planar region 61 is provided with an inclined surface 41 forming a wall or step 63 for engaging the upper most coin in a shingled pair. In FIG. 2, for example, an upper coin C2 is shingled over a lower coin C3. As further shown in FIG. 3, movement of the upper coin C2 is limited by the wall 63 so that the upper coin C2 is forced off of the lower coin C3 as the lower coin is moved by the rotating disc 13.

Figure 4:
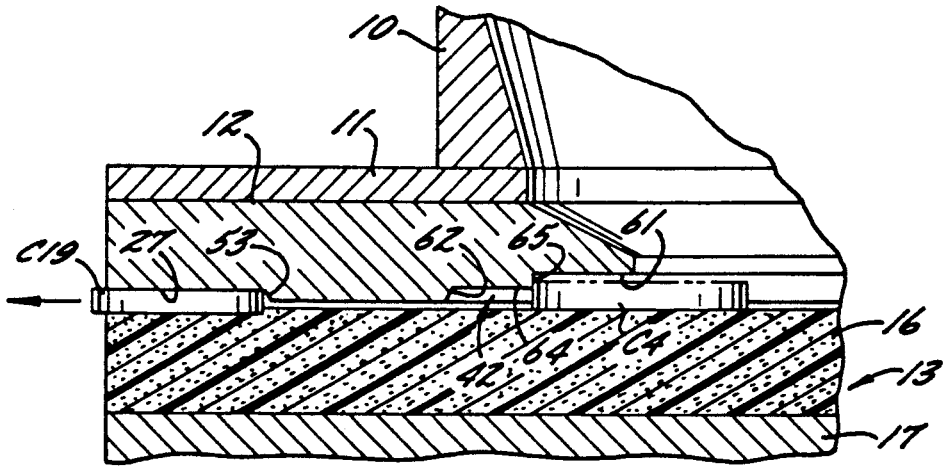
FIG. 4 is an enlarged section taken generally along line 4—4 in FIG. 2, showing in full elevation a nickel registered with an ejection recess.

Returning to FIG. 2, the circulating coins in the entrance region 40, such as the coin C1, are next directed to the means 42 for selecting thick coins. This means 42 includes a surface 64 recessed into the sorting head 12 at a depth of 0.070 inches (1.78 mm) from the lower (cross-hatched) surface of the sorting head. Therefore, a step or wall 65 is formed between the surface 61 of the entrance region 40 and the surface 64. The distance between the surface 64 and the upper surface of the disc 13 is therefore about 0.075 inches so that relatively thick coins between the surface 64 and the disc 13 are held by pad pressure. To initially engage such thick coins, an initial portion of the surface 64 is formed with a ramp 66 located adjacent to the wall 62. Therefore, as the disc 13 rotates, thick coins in the entrance region that are next to the wall 62 are engaged by the ramp 66 and thereafter their radial position is fixed by pressure between the disc and the surface 64. Thick coins which fail to initially engage the ramp 66, however, engage the wall 65 and are therefore recirculated back within the central region of the sorting head. This is illustrated, for example, in FIG. 4 for the coin C4. This initial selecting and positioning of the thick coins prevents misaligned thick coins from hindering the flow of coins to the first referencing means (45 in FIG. 2).

Figure 5:
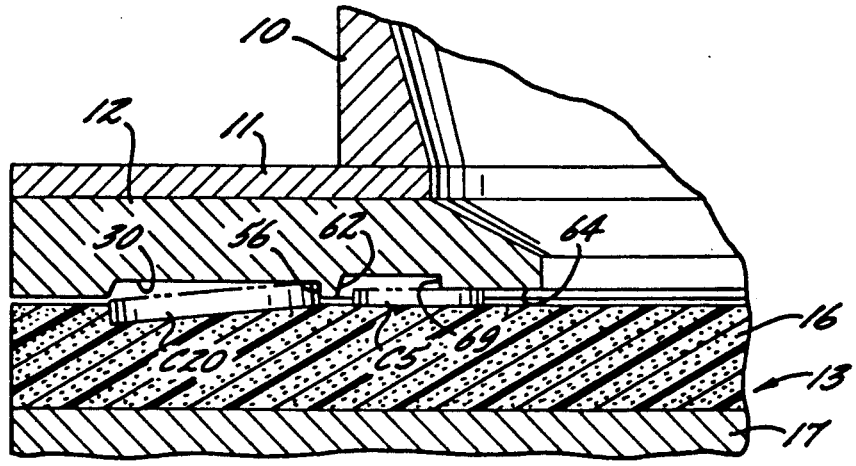
FIG. 5 is an enlarged section taken generally along line 5—5 in FIG. 2.

Returning now to FIG. 2, it should be apparent that the ramp 66 in the means 42 for selecting the thick coins can also engage a pair or stack of thin coins Such a stack or pair of thin coins will be carried under pad pressure between the surface 64 and the rotating disc 13. In the same manner as a thick coin, such a pair of stack coins will have its radial position fixed and will be carried toward the first referencing means 45. This first referencing means 45 is a surface 67 located at a depth of about 0.110 inches (2.79 mm) which is large enough to permit even the thickest coin to pass freely between the sorting head 12 and the rotating disc 13, so that the coins are lined up against the outer wall 62 by centrifugal force. To aid disengagement of the thick coins from the surface 64, the surface 64 is terminated by a ramp 68 which has an outermost edge terminating in a wall 69 between the surface 64 and the surface 67. This wall is further shown in FIG. 5, which illustrates the engagement of the terminal portion of the surface 64 with a portion of a coin such as the coin C5.

In many cases, however, centrifugal force is insufficient to provide a steady flow of coins to the first referencing means 45. Such is the case for stacked or double coins, such as the pair of dimes C6 and C7. Therefore there is provided means 43 for breaking up the double coins, including means defining a deflecting wall 71 presented to the upper most of the stacked coins, causing in most cases the upper most coin to be deflected towards the first referencing means 45. The deflecting wall 71 also deflects any thick coins toward the first referencing means 45.

Figure 6:
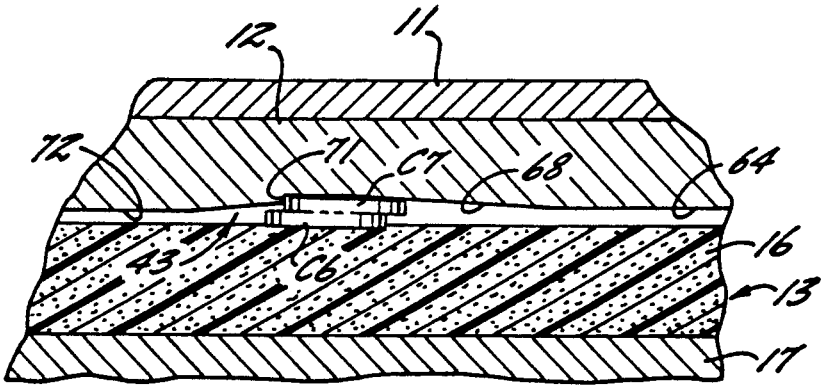
FIG. 6 is an enlarged section taken generally along line 6—6 in FIG. 2, showing in full elevation a pair of stacked dimes just prior to being broken up.
Figure 7:
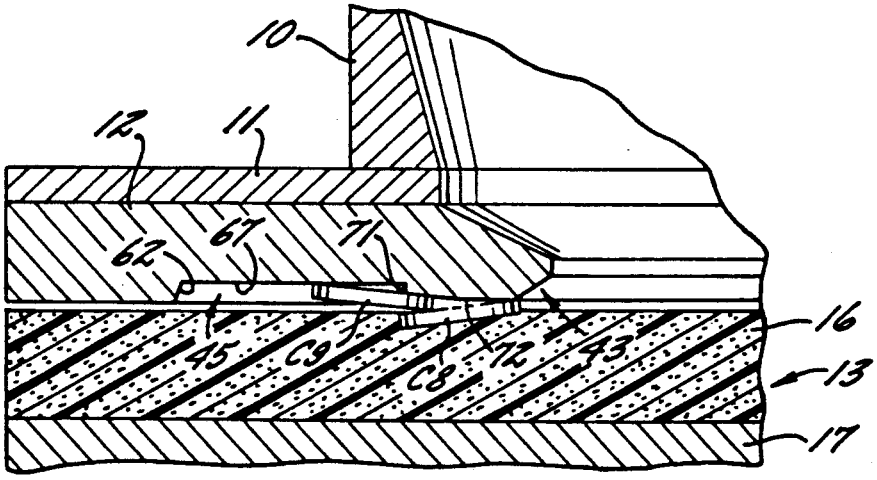
FIG. 7 is an enlarged section taken generally along line 7—7 in FIG. 2, showing in full elevation a pair of stacked dimes being broken up.

The breaking up of a pair of stacked dimes is further illustrated in FIG. 6 and 7. In FIG. 6 the upper dime C7 engages the deflecting wall 71 as the rotating disc 13 continues to circulate the lower dime C6. Therefore, the upper dime C7 is stripped from the lower dime C6. Furthermore, in accordance with an important aspect of the present invention, the lower dime C6 becomes engaged between the rotating disc 17 and a surface 72 in order to carry the lower dime to a first recirculating means (44 in FIG. 2).

As further shown in FIG. 7, it is possible for a small portion of a coin such as a coin C8 to be engaged by the surface 72 so that an upper coin C9 could still be trapped between the lower coin C8 and the sorting head 12. In this situation, it is possible for both coins to be recirculated by the first recirculating means (44 in FIG. 2) or possibly the upper coin C9 will be recirculated by the second recirculating means (46 in FIG. 2). For conditions such as shown in FIG. 7, the use of both a first and second recirculating means ensures an uninterrupted flow of coins to the first referencing means (45 in FIG. 2) and a very low probability of miss-sorting due to stacked or double coins.

Figure 8:
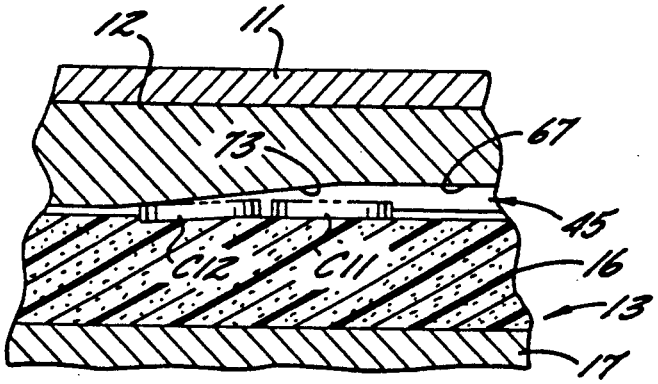
FIG. 8 is an enlarged section taken generally along line 8—8 in FIG. 2, showing in full elevation a pair of dimes being fed to a first registering means.

Returning now to FIG. 2, the first means 45 for referencing the coins obtains a single-file stream of coins directed against the outer wall 62 and leading up to a ramp 73. As further shown in FIG. 8, for example, coins C11 and C12 are aligned against the wall 62 and become engaged between the rotating disc 13 and the sorting head 12. At the terminal end of the ramp 73, the coins become firmly pressed into the pad 16 and are carried forward to the second referencing means (47 in FIG. 2).

Returning now to FIG. 2, it should be apparent that a coin such as the coin C12 will be carried forward to the second referencing means 47 so long as a portion of the coin is engaged by the terminal portion of the ramp 73. If a coin is not sufficiently close to the wall 62 so as to be engaged by the terminal portion of this ramp 73, then the coin strikes a wall 74 defined by the second recirculating means 46, and that coin is recirculated back to the entrance region 40.

Figure 9:
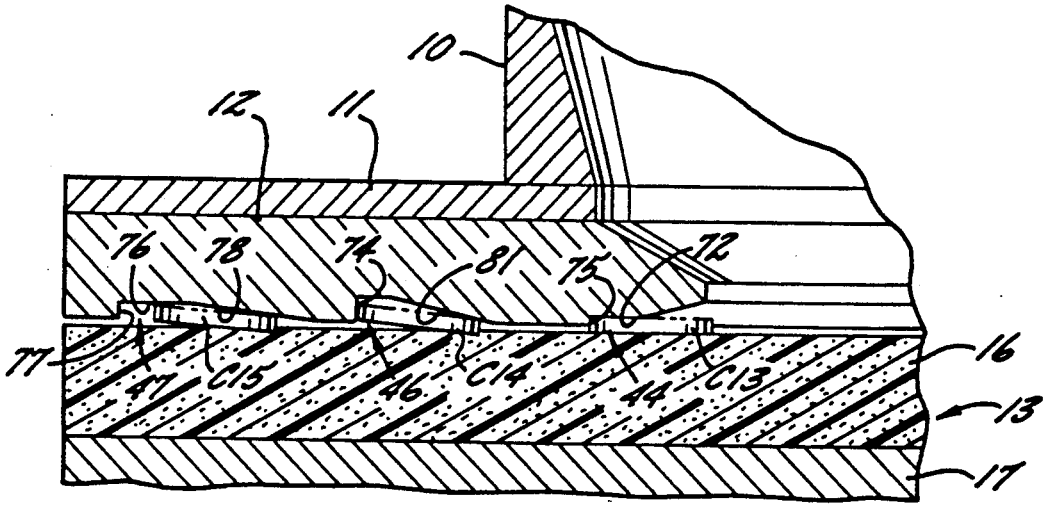
FIG. 9 is an enlarged section taken generally along line 9—9 in FIG. 2, showing in full elevation a first dime in a first recirculating means, a second dime in a second recirculating means, and a third dime in a second registering means.

Turning now to FIG. 9, it is seen that the first recirculating means 44, the second recirculating means 46 and the second referencing means 47 are defined at successive positions in the sorting head 12. It should be apparent that the first recirculating means 44, as well as the second recirculating means 46, recirculate the coins under positive control of pad pressure The second referencing means 47 also uses positive control of the coins to align the outer most edge of the coins with a gaging wall 77. For this purpose, the second referencing means 47 includes a surface 76, for example, at 0.050 inches (1.27 mm) from the bottom surface of the sorting head 12, and a ramp 78 which engages the inner edge portions of the coins, such as the coin C15.

Figure 3:
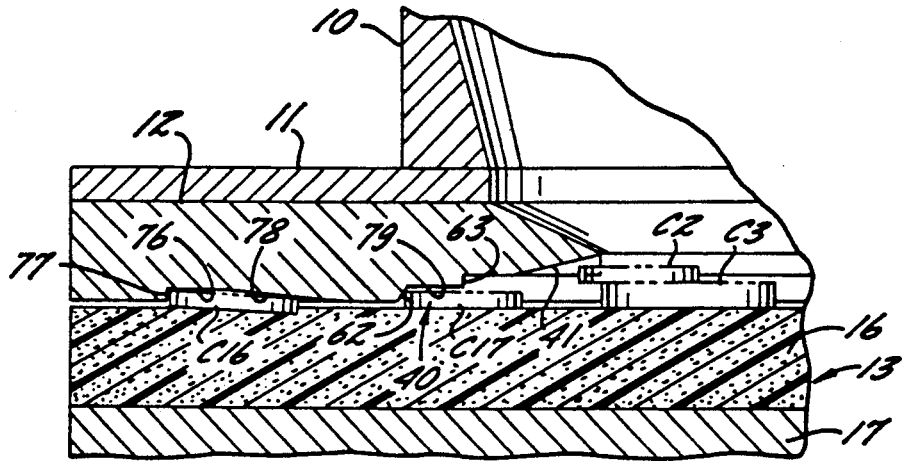
FIG. 3 is an enlarged section taken generally along line 3—3 in FIG. 2, showing the coins in full elevation.

As better shown in FIG. 2, the initial portion of the gaging wall 77 is along a spiral path with respect to the center of the sorting head 12 and the sorting disc 13, so that as the coins are positively driven in the circumferential direction by the rotating disc 13, the outer edge of the coins engages the gaging wall 77 and are forced slightly radially inward to a precise gaging radius, as shown for the coin C16 in FIG. 3. FIG. 3 further shows a coin C17 having been ejected from the second recirculating means 46. Also shown in FIG. 3 is a surface 79 extending from the second recirculating means and which is located, for example, at 0.065 inches (1.65 mm) above the lower (cross-hatched) surface of sorting head 12.

Figure 10:
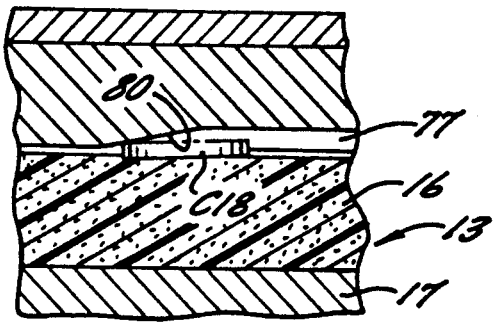
FIG. 10 is an enlarged section taken generally along line 10—10 in FIG. 2, showing a final registering operation being performed by the second registering means.

The second referencing means 47 terminates with a slight ramp 80 causing the coins to be firmly pressed into the pad 16 on the rotating disc with their outer most edges aligned with the gaging radius provided by the gaging wall 77. This is illustrated in FIG. 10 for the coin C18. At the terminal end of the ramp 80 the coins are gripped between the guide plate 12 and the resilient pad 16 with the maximum compressive force. This ensures that the coins are held securely in the new radial position determined by the wall 77 of the second referencing means (47 in FIG. 2).

Returning now to FIG. 2, the sorting head 12 further includes sorting means comprising a series of ejection recesses 48, 49, 27, 28, 29, 30 spaced circumferentially around the outer periphery of the plate, with the innermost edges of successive slots located progressively farther away from the common radial location of the outer edges of all the coins for receiving and ejecting coins in order of increasing diameter. The width of each ejection recess preferably is smaller than the diameter of the coin to be received and ejected by that particular recess, and the surface of the guide plate adjacent the radially outer edge of each ejection recess presses the outer portions of the coins received by that recess into the resilient pad so that the inner edges of those coins are tilted upwardly into the recess. The ejection recesses extend outwardly to the periphery of the guide plate so that the inner edges of these recesses guide the tilted coins outwardly and eventually eject those coins from between the guide plate 12 and the resilient pad 16.

It has been found that the coins can be reliably sorted and ejected at high throughput rates, while being pressed into the resilient pad, without the use of auxiliary coin-tilting devices such as depressors or plows. More specifically, the innermost edges of the ejection recesses are positioned so that the inner edge of a coin of only one particular denomination can enter each recess; the coins of all other remaining denominations extend inwardly beyond the innermost edge of that particular recess so that the inner edges of those coins cannot enter the recess. Thus, all the coins except the dimes bypass the recess 48.

For example, the first ejection recess 48 is intended to discharge only dimes, and thus the innermost edge 51 of this recess is located at a radius that is spaced inwardly from the radius of the gaging wall 77 by a distance that is only slightly greater than the diameter of a dime. Consequently, only dimes can enter the recess 48. Because the outer edges of all denominations of coins are located at the same radial position when they leave the second referencing means 47, the inner edges of the pennies, nickels, quarters, dollars and half dollars all extend inwardly beyond the innermost edge of the recess 48, thereby preventing these coins from entering that particular recess.

At recess 49, the inner edges of only pennies are located close enough to the periphery of the sorting head 12 to enter the recess. The inner edges of all the larger coins extend inwardly beyond the innermost edge 52 of the recess 49 so that they remain gripped between the guide plate and the resilient pad. Consequently, all the coins except the pennies continue to be rotated past the recess 52.

Similarly, only nickels enter the ejection recess 27, only the quarters enter the recess 28, only the dollars enter the recess 29, and only the half dollars enter the recess 30.

Because each coin is gripped between the sorting head 12 and the resilient pad 16 throughout its movement through the ejection recess, the coins are under positive control at all times. Thus, any coin can be stopped at any point along the length of its ejection recess, even when the coin is already partially projecting beyond the outer periphery of the guide plate. Consequently, no matter when the rotating disc is stopped (e.g., in response to the counting of a preselected number of coins of a particular denomination), those coins which are already within the various ejection recesses can be retained within the sorting head until the disc is re-started for the next counting operation.

Figure 11:
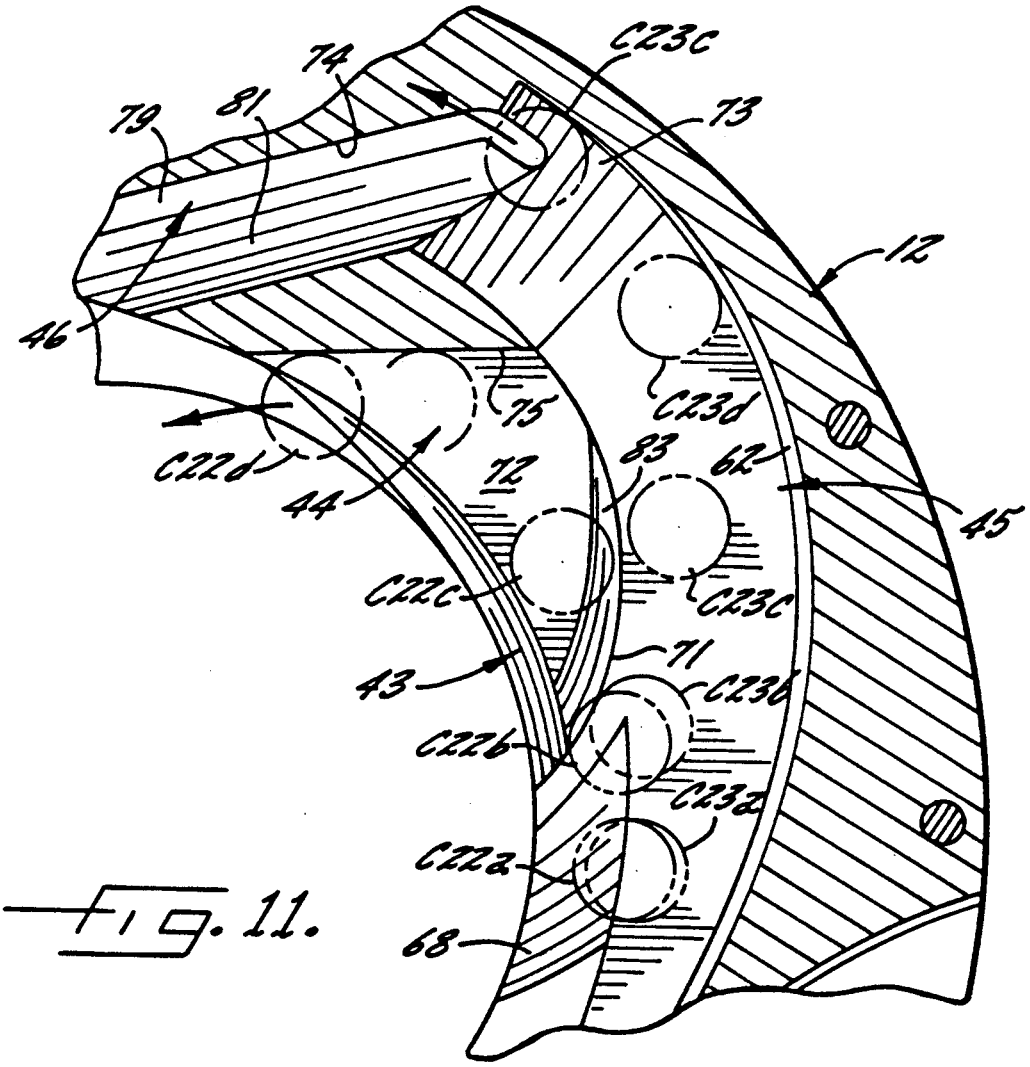
FIG. 11 is a right-hand portion of FIG. 2 with certain coins superimposed thereon to illustrate the splitting and recycling a stacked pair of dimes.

Turning now to FIG. 11, there is shown an enlarged portion of FIG. 2 to more clearly illustrate the operation of the means 43 for breaking up double coins and its relationship to the first means 44 for recirculating coins, the first referencing means 45 and the second means 46 for recirculating coins. Shown in FIG. 11 is the typical case in which a stacked pair of coins including a lower coin C22*a* and an upper coin C23*a* are carried below the ramp 68 and in which the upper coin C23*b* becomes engaged with the wall 71 of the means 43 for breaking up the double coins. The lower coin C22*b* becomes engaged under the surface 72 and is carried in a circumferential direction to the position C22*c*. Once the double coins are broken up, the upper coin is deflected by the deflecting wall 71, which has a height of approximately 0.050 inches along the outer radial edge of most of the ramp 83, although there is a gap of approximately 0.065 inches (1.40 mm) between the lower edge of the deflecting wall 71 and the upper surface of the rotating disc 13. As shown in FIG. 11, the deflected coin is carried by centrifugal force to position C23*d* and becomes engaged at the position C23*e* by the ramp 73 of the first referencing means 45.

It should be apparent that in the case of FIG. 11 the lower coin of a pair of stacked coins is recirculated by the first recirculating means 44. This is desirable because in the case of double coins, the coins would otherwise be fed to the first referencing means 45 at a rate twice as fast as the rate at which the referencing means can handle them. Although the referencing means 45 does have a second means 46 for rejecting excess coins by way of recess 81, the reduction in the load of coins upon the second recirculating means prevents stacked coins from impeding the operation of the first referencing means 45 and prevents stacked coins from being fed to the second recirculating means. Such double coins could very well cause a miss-sort because they could be carried up the ramp 73 and over the wall 74 of the second recirculating means.

The use of two separate recirculating means also ensures that both of the coins in a stacked pair are recirculated for the anomalous condition shown in FIG. 7. In such a case, the stacked coins will be broken up by the wall 75 and will both be recirculated by the wall 75, or possibly one will be recirculated by the wall 75 of the first recirculating means and the other will be recirculated by the wall 74 of the second recirculating means 46. In any event, the double coins are broken up without impeding the flow of coins to the first recirculating means, and therefore the possibility of miss-sorting is reduced without reducing the sorting speed.

What is claimed is:

1. A coin sorter for sorting coins in terms of their denomination comprising:

a rotatably mounted coin-carrying disc having a resilient surface onto which coins may be fed;

means for rotating said disc;

a guide plate having a central opening and a configured surface positioned closely adjacent to said disc and covering said resilient surface, and wherein said configured surface includes an inner recess within which coins move radially, and said inner recess extends outwardly from said central opening, said guide plate forming a referencing means for receiving coins of all denominations and providing a single-file stream of the coins of all denominations positioned at a common radial location, sorting means disposed around the outer periphery of said guide plate for receiving said single-file stream of coins and sorting the coins in said stream according to their respective denominations, and means formed in said guide plate for breaking up stacked coins moving from said central opening toward said referencing means, wherein said means for breaking up stacked coins includes first means for recirculating coins including coins from the stacked coins broken up by said means or breaking up stacked coins, and wherein said referencing means includes a second means for recirculating coins including excess coins forming a stream of coins not adjacent to said referencing means, but moving to said referencing means in greater numbers than can be accommodated in said single-file stream of coins adjacent to referencing means, and wherein said first means for recirculating coins directs coins away from the coins travelling in the said second means for recirculating coins.

2. The coin sorter as claimed in claim 1, wherein said means for breaking up stacked coins includes means for defining a deflecting wall extending from a recess in said guide plate but being spaced sufficiently from said resilient surface of said disc to permit a first coin of a stacked pair of coins to pass between said means defining said deflecting wall and said resilient surface of said disc while the second coin in said stacked pair of coins is deflected by said deflecting wall.

3. The coin sorter as claimed in claim 2, wherein said deflecting wall is curved toward said referencing means.

4. The coin sorter as claimed in claim 2, wherein said means defining said deflecting wall has a ramp extending from an edge of said wall to the planar region adjacent to said resilient surface of said disc, said ramp extending toward said first recirculating means and toward said resilient surface to provide means for positively engaging the first one of said coins in said stacked pair of coins.

5. The coin sorter as claimed in claim 4, wherein said ramp extends to a planar region, and said first means for recirculating includes means defining a first wall across said planar region for deflecting coins toward said central opening.

6. The coin sorter as claimed in claim 5, wherein said second means for recirculating coins includes a recess in said guide plate defining a second wall for deflecting said excess coins toward said central opening.

7. The coin sorter as claimed in claim 2, wherein said first means for recirculating coins includes means defining a first wall in said guide plate for deflecting said coins from the stacked coins broken up toward said central opening, and said second means for recirculating coins includes means defining a second wall in said guide plate for deflecting said excess coins toward said central opening.

8. The coin sorter as claimed in claim 2, further comprising thick coin selecting means for recirculating thick coins that are not initially referenced to an extreme outward radial position before the thick coins move from said central opening to said means for breaking up stacked coins.

9. The coin sorter as claimed in claim 8, wherein said means for recirculating thick coins includes a ramp at said extreme position for engaging said thick coins between a surface defined in said guide plate and said resilient surface of said disc.

10. The coin sorter as claimed in claim 9, wherein said thick coin selecting means includes means defining a deflecting wall for deflecting toward said central opening thick coins which fail to be engaged by said ramp.

11. The coin sorter as claimed in claim 10, wherein said ramp terminates in a planar region bounded by said deflecting wall, said planar region being sufficiently spaced from the resilient surface of said disc to permit thin coins to freely pass between said planar region and said resilient surface.

12. A coin sorter for sorting coins in terms of their denomination comprising:

a rotatably mounted coin-carrying disc having a resilient surface onto which coins may be fed;

means for rotating said disc;

a guide plate having a central opening and a configured surface positioned closely adjacent to said disc and covering said resilient surface, and wherein said configured surface includes an inner recess within which coins move radially, and said inner excess extends outwardly from said central opening, said guide plate forming a referencing means for receiving coins of all denominations and providing a single-file stream of the coins of all denominations positioned at a common radial location, sorting means disposed around the outer periphery of said guide plate for receiving said single-file stream of coins and sorting the coins in said stream according to their respective denominations, and means formed in said guide plate for breaking up stacked coins moving from said central opening toward said referencing means, wherein said means for breaking up stacked coins includes means for defining a deflecting wall including an upper portion being substantially perpendicular to the surface of said disk and a lower portion being tapered toward a planar region adjacent to said resilient surface of said disk, said deflecting wall extending from a recess in said guide plate but being spaced sufficiently from said resilient surface of said disc to permit a lower coin of a stacked pair of coins to pass between said means defining said deflecting wall and said resilient surface of said disc while an upper coin in said stacked pair of coins is deflected by said deflecting wall, and the lower surface of said guide plate adjacent the upstream side of said deflecting wall extends horizontally away from the upper end of said perpendicular upper portion of said deflecting wall and then slopes downwardly to a planar surface that is located at least as close to said resilient surface of said disc as the lower end of said perpendicular upper portions of said deflecting wall, whereby the front end of a coin or pair of stacked coins is lifted as the said coin or said pair of coins approaches said deflecting wall to direct said coin or the upper one of the said pair of stacked coins into said perpendicular upper portion of said deflecting wall for breaking up stacked coins to deflect the said coin or the upper one of said coins in the said stacked pair of coins toward said referencing means.

13. The coin sorter as claimed in claim 12, wherein said deflecting wall is curved toward said referencing means.

14. A coin sorter for sorting coins in terms of their denomination comprising:

a rotatably mounted coin-carrying disc having a resilient surface onto which coins may be fed;

means for rotating said disc;

a guide plate having a central opening and a configured surface positioned closely adjacent to said disc and covering said resilient surface, and wherein said configured surface includes an inner recess within which coins move radially, and said inner recess extends outwardly from said central opening, said guide plate forming a referencing means for receiving coins of all denominations and providing a single-file stream of the coins of all denominations positioned at a common radial location, sorting means disposed around the outer periphery of said guide plate for receiving said single-file stream of coins and sorting the coins in said stream according to their respective denominations, and means formed in said guide plate for breaking ups stacked coins moving from said central opening toward said referencing means, wherein said means for breaking up stacked coins includes first means for recirculating coins including coins from the stacked coins broken up by said means for breaking up stacked coins, and wherein said referencing means includes a second means for recirculating coins including excess coins forming a stream of coins not adjacent to said referencing means, but moving to said referencing means in greater numbers than can be accommodated in said single-file stream of coins, and wherein said means for breaking up stacked coins includes means for directing a first coin in a pair of stacked coins to said first means for recirculating and directing the second coin in said pair of stacked coins to said referencing means, and wherein first means for recirculating coins directs coins away from the coins travelling in said second means for recirculating coins.

* * * * *